US006850730B2

(12) United States Patent
Adams

(10) Patent No.: US 6,850,730 B2
(45) Date of Patent: Feb. 1, 2005

(54) PLATEN COVER POSITIONING SYSTEM FOR AN INPUT SCANNER OR COPIER

(75) Inventor: John N. Adams, Knebworth (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/443,409

(22) Filed: May 22, 2003

(65) Prior Publication Data

US 2004/0234311 A1 Nov. 25, 2004

(51) Int. Cl.[7] ..... G03G 15/00
(52) U.S. Cl. ..... 399/380; 399/379; 399/16
(58) Field of Search ..... 399/16, 17, 371, 399/379, 380

(56) References Cited

U.S. PATENT DOCUMENTS 4,585,329 A 4/1986 Landa ..... 355/3 R
4,593,186 A * 6/1986 Swartz et al. ..... 235/462.36
4,882,603 A 11/1989 Sakata ..... 355/75
5,778,276 A * 7/1998 Hasegawa ..... 399/17
6,408,161 B1 * 6/2002 Minowa et al. ..... 399/380
6,457,133 B1 * 9/2002 Watari et al. ..... 713/320
6,510,301 B2 1/2003 Tanaka ..... 399/125
6,519,569 B1 * 2/2003 White et al. ..... 705/3

FOREIGN PATENT DOCUMENTS

JP 2001005120 A * 1/2001 ..... G03B/27/50

* cited by examiner

*Primary Examiner*—Andrew H. Hirshfeld
*Assistant Examiner*—Dave A. Ghatt
(74) *Attorney, Agent, or Firm*—R. Hutter

(57) ABSTRACT

In a copier or input scanner wherein original documents are manually placed on a platen for scanning, when a platen cover is lowered over the document and approaches a closed position, a control system initiates a scanning operation while locking the platen cover in the closed position. After the scanning operation is completed, the platen cover is automatically pushed into an open position as a visual cue to the user that a new document may be scanned. The system facilitates manual scanning of odd-shaped documents, such as successive pages of bound books.

5 Claims, 2 Drawing Sheets

PLATEN COVER POSITIONING SYSTEM FOR AN INPUT SCANNER OR COPIER

TECHNICAL FIELD

The present disclosure relates to machines, such as copiers or digital input scanners, which record hard-copy original images placed on a platen. More specifically, the present disclosure relates to a system for positioning a platen cover used with such a machine.

BACKGROUND

Copiers, whether using digital or light-lens imaging technology, are well known. Input scanners, which record a hard-copy image as digital data, are becoming commonplace as well. A typical copier or scanner (hereinafter "machine") includes a "platen," which is a transparent window on which sheets bearing images (hereinafter "documents") to be copied or otherwise recorded (hereinafter "scanned") are manually placed. Associated with a platen is usually a "platen cover," which is lowered on the platen and the document, to provide a background to the document during scanning. When the machine is not in use, the platen cover is lowered to protect the platen. It is also typical to have at least a portion of a document handler, which makes a succession of documents available for scanning, incorporated into the platen cover.

In situations where use of a document handler is not advisable, such as with a set of odd-shaped, fragile, and/or damaged documents, or successive pages of a bound book, a user will wish to place each document manually on the platen, lifting the platen cover before scanning each document, placing the document, closing the platen cover, and then, typically, pushing a copy or scan button. The process is repeated for each of a series of documents. This repetitive sequence can lead to mistakes, such as: pushing the button without having a document on the platen, accidentally scanning the same document twice, pushing the button without the platen being fully closed, etc.

PRIOR ART

U.S. Pat. No. 4,585,329 discloses a copier which locks the platen cover shut when the body of the copier is opened for maintenance.

U.S. Pat. No. 4,882,603 discloses a copier in which the platen cover includes a "pressing member" which flattens a document as the platen cover is closed.

U.S. Pat. No. 6,510,301 discloses a copier in which a document handier is part of the platen cover. When the document cover is opened, such as for jam clearance, the platen cover is locked down.

The Xerox® "9200" product, released about 1980, had a system including a solenoid for locking down a platen cover during the scanning operation. In that case, the motivation for the locking was to protect a user's eyes from intense light associated with the scanning process.

SUMMARY

According to one aspect of the present invention, there is provided a machine for scanning documents, comprising a platen, for bearing a document to be scanned, and a platen cover, pivotably mounted to a body of the machine. The platen cover is pivotable to a closed position wherein the platen cover substantially urges the document against the platen, and an open position. A control system causes the mechanism to release the platen cover from the closed position in response to completing a scanning operation.

According to another aspect of the present invention, there is provided a machine for scanning documents, comprising a platen, for bearing a document to be scanned, and a platen cover, pivotably mounted to a body of the machine. The platen cover is pivotable to a closed position wherein the platen cover substantially urges the document against the platen, and an open position. A control system initiates a scanning operation in response to the platen cover approaching the closed position.

DETAILED DESCRIPTION

Figure 1:
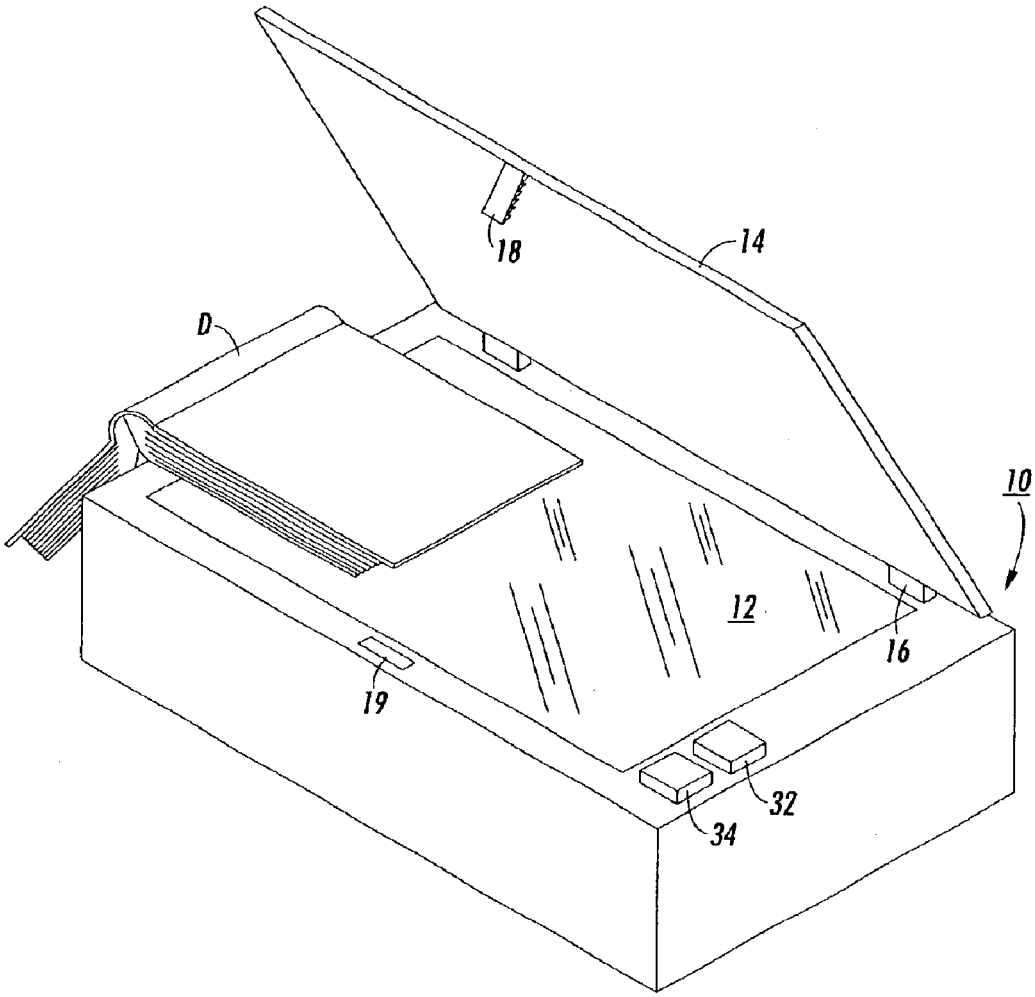
FIG. 1 is a perspective view of a machine for scanning a document.

FIG. 1 is a perspective view of a machine for scanning a document. The machine 10 can be either a copier, which would also outputs copies or other prints, or simply be a stand-alone scanner which outputs digital data based on images recorded from scanned documents. The machine 10 includes a light-transmissive platen 12, suitable for bearing documents to be scanned, and a platen cover 14, which is pivotably mounted relative to the platen 12 by one or more hinges 16. The platen cover 14 can be in an open position, as shown in the Figure, or can be lowered into a "closed" position, in which the platen cover in effect urges a document against the platen 12 for clear, focused recording of the image thereon. In the Figure, the document D in question is an open book, but a document can be any object or artifact having or forming a recordable image, such as a single sheet of paper, a package, a small item, etc. In order for platen cover 14 to urge a relatively thick item such as a book onto platen 12, the hinges 16 may have to be specially adapted with slide mounts or extra joints, but basic designs for such hinges are generally known in the art.

In situations where it is desired to record images from a series of odd-shaped documents which must be manually placed on platen 12, the position of platen cover 14 at any time can be automatically monitored, by a control system within scanner 10, and used to activate a scanning operation by machine 10. In the illustrated embodiment, extending from platen cover 14 is what can be called a ratchet member 18, which, as platen cover 14 approaches a closed position, is inserted into an opening 19. The ratchet member 18 defines teeth, which can be engaged by a pawl member near opening 19, as will be described below.

Figure 2:
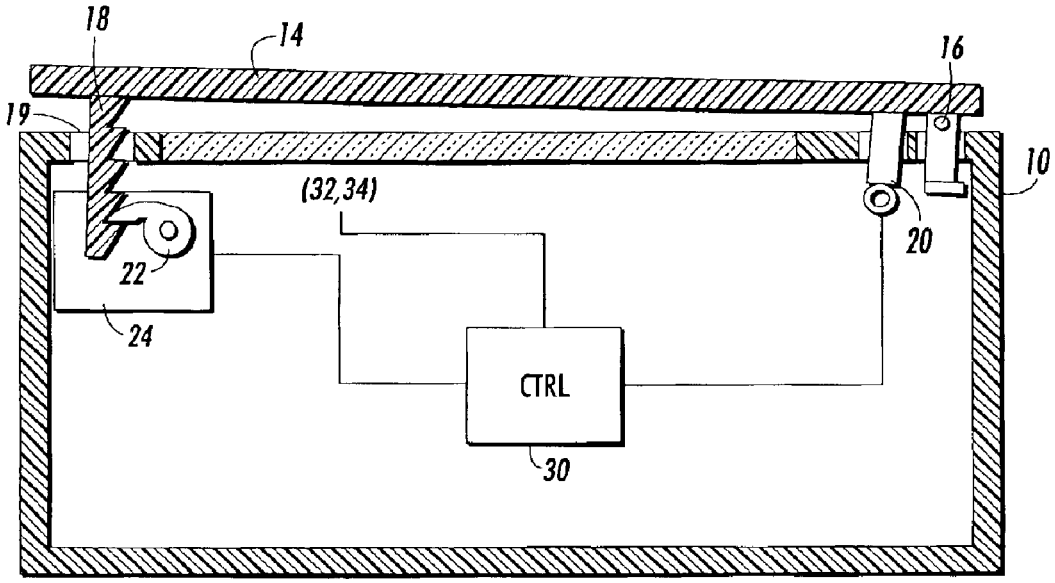
FIG. 2 is a sectional elevational view showing elements of the machine of FIG. 1.

FIG. 2 is a sectional elevational view showing elements of the machine of FIG. 1. Near hinges 16, and engaging platen cover 14, is a solenoid 20 or other mechanism. The solenoid 20 (and there may be, in possible embodiments, multiple solenoids) is capable of moving platen cover 14 upward from a closed to at least a somewhat open position; alternately, or addition, the solenoid 20 (or another solenoid forming part of the mechanism) is capable of drawing the platen cover 14 downward to a closed position, such as to urge a document D such as a book against platen 12. Near ratchet member 18, where ratchet 18 enters opening 19, there is provided a pawl 22 or other device which contacts teeth of ratchet 18, and, as needed, in effect locks the platen cover 14 into a closed position by locking into the teeth. As such, pawl 22 is associated with a small position sensor 24 which can emit a signal when the pawl 22 is contacted by ratchet member 18 (thus detecting the approach of platen cover 14 to a closed position) and also respond to an external signal to lock the ratchet member 18 in place. The solenoid 20 and position sensor 24 are both associated with a control system 30.

In one embodiment of the operation of a machine 10 in a predetermined mode, when platen cover 14 is lowered over a document D sufficiently that a portion of ratchet member 18 is inserted into opening 19 and contacts pawl 22, a lowered position of platen cover 14 is sensed and used by the control system 30 to initiate a scanning operation (such as through a photosensitive device, not shown in the Figure but inherent in all scanning machines). When the scanning operation is completed, control system 30 causes solenoid 20 to push platen cover 14 upward and out of a closed position, thus freeing the document for removal and giving a user a visual cue that the scanning is completed. In this way, the position of platen cover 14 is used to cause the machine to begin a scanning operation, and to indicate to a user that the scanning operation is completed. With this embodiment, a user does not have to push a "copy button" to directly initiate a scanning operation, but rather need only lower the platen cover to perform the scanning; also, because the user gets a visual cue of the platen cover being raised (if only slightly) when the scanning is complete, the user will not accidentally remove the document from the platen before it is scanned.

In alternate embodiments, the pawl 22 can be used to lock the platen cover 14 in the closed position during the scanning operation, especially to ensure that the platen cover 14 is not raised, or the document removed from platen 12, before scanning is complete. Similarly, the solenoid 20 (or another solenoid or equivalent device) can be used to effectively perform the locking instead of having the ratchet member 18 and pawl 22. The position of the platen cover 14 at any time can be detected using any kind of optical or mechanical sensor, associated with the platen cover 14 itself or with the solenoids 20 or other mechanism. The solenoid 20 can be used in combination with a spring (not shown) which is compressed when the platen cover is pushed downward, and which then is used to push the platen cover 14 slightly upward when the platen cover 14 is unlocked.

Other devices or steps may be used in conjunction with the above embodiment in addition to the visual cue of the platen cover 14 raising after the scanning operation, there may provided a light (such as shown in FIG. 1 as 32) or an auditory cue such as a tone. After the platen cover 14 is locked in a closed position, the system may nonetheless request the user to push the "copy button" (such as shown in FIG. 1 as 34) to start the scanning operation, such a request perhaps being the form of a light or an auditory cue from control system 30.

In alternate embodiments, the ratchet member 18 might be mounted in the base unit of the machine, and the pawl 22 in the platen cover 14 (or within a document handler associated therewith). This would prevent the ratchet member 18 accidentally damaging or piercing the document when the platen cover 14 was lowered, since the document would necessarily have to be positioned beside the ratchet member. The ratchet member 18 might be capable of being retracted, for safety when not in use, with perhaps a simple spring release button.

Of course, the above-described embodiment would be used mainly in situations where one or more documents were being scanned by manual placement on the platen, and as such would probably be manifest in one of many selectable operational modes of the machine. Also, when using a machine in a mode wherein the platen cover is temporarily locked in a closed position during the scanning operation, it is desirable to have a manual override of the locking mechanism.

What is claimed is:

1. A machine for scanning documents, comprising:

a platen, for bearing a document to be scanned;

a platen cover, pivotably mounted to a body of the machine, the platen cover being pivotable to a closed position wherein the platen cover substantially urges the document against the platen, and an open position;

a control system for initiating a scanning operation in response to the platen cover approaching the closed position and causing the platen cover to lock in the closed position during the scanning operation; and a mechanism for detecting the platen cover approaching the closed position and locking the platen cover in the closed position the mechanism including a member extending from the, platen cover, and a pawl for contacting the member to detect the platen cover approaching the closed position and engaging the member to lock the platen cover in the closed position.

2. The machine of claim 1, the control system causing the mechanism to release the platen cover from the closed position in response to completing a scanning operation.

3. The machine of claim 1, further comprising a mechanism for pushing the platen cover from the closed position to the open position; and the control system causing the mechanism to push the platen cover from the closed position to the open position in response to completing the scanning operation.

4. The machine of claim 1, the control system unlocking the platen cover in response to completing the scanning operation.

5. The machine of claim 1, the control system causing an auditory cue in response to completing the scanning operation.

* * * * *